US005248476A

United States Patent [19]

Slattery et al.

[11] Patent Number: 5,248,476

[45] Date of Patent: Sep. 28, 1993

[54] FUSIBLE ALLOY CONTAINING BISMUTH, INDIUM, LEAD, TIN AND GALLIUM

[75] Inventors: James A. Slattery, Sauquoit; Charles E. T. White, Clinton; George E. Kraeger, Constableville; John R. Sovinsky, Liverpool, all of N.Y.

[73] Assignee: The Indium Corporation of America, Utica, N.Y.

[21] Appl. No.: 876,407

[22] Filed: Apr. 30, 1992

[51] Int. Cl.[5] ..... C22C 12/00; C22C 30/00

[52] U.S. Cl. ..... 420/577; 420/589

[58] Field of Search ..... 420/577, 589

[56] References Cited

U.S. PATENT DOCUMENTS

| | | | |
|---|---|---|---|
| 1,612,151 | 12/1926 | Richardson | 420/514 |
| 2,595,925 | 5/1952 | Carlson et al. | 420/589 |
| 2,624,107 | 1/1953 | Carpenter | 29/286 |
| 2,649,367 | 8/1953 | Smith et al. | 420/589 |
| 2,649,368 | 8/1953 | Smith et al. | 420/555 |
| 2,649,370 | 8/1953 | Smith et al. | 420/577 |
| 2,680,071 | 6/1954 | Epstein et al. | 420/555 |
| 2,717,840 | 9/1955 | Bosch | 117/70 |
| 3,023,393 | 2/1962 | Oliver | 339/118 |
| 3,078,397 | 2/1963 | Tummers et al. | 317/235 |
| 3,128,090 | 7/1964 | Anderson | 269/7 |
| 3,141,238 | 4/1964 | Harman | 29/498 |
| 3,538,231 | 11/1970 | Newkirk et al. | 13/25 |
| 3,790,152 | 2/1974 | Parsons | 269/7 |
| 3,897,535 | 7/1975 | Lapac et al. | 264/268 |
| 3,921,343 | 11/1975 | Speyer | 51/323 |
| 3,982,430 | 9/1976 | Pommellet et al. | 73/146 |
| 4,083,718 | 4/1978 | Murabayashi et al. | 420/577 |
| 4,123,262 | 10/1978 | Cascone | 420/510 |
| 4,214,903 | 7/1980 | Murabayashi et al. | 420/577 |
| 4,509,673 | 4/1985 | Schmidt et al. | 228/212 |
| 4,539,176 | 9/1985 | Cascone | 420/463 |
| 4,623,514 | 11/1986 | Arora et al. | 420/555 |
| 4,816,219 | 3/1989 | Nishimura | 420/589 |
| 4,879,096 | 11/1989 | Nation | 420/561 |
| 4,966,141 | 10/1990 | Zimmerman et al. | 228/263.12 |

FOREIGN PATENT DOCUMENTS

| | | |
|---|---|---|
| 136866 | 9/1984 | European Pat. Off. . |
| 59-116357 | 7/1984 | Japan . |
| 59-153857 | 9/1984 | Japan . |
| 61-67743 | 4/1986 | Japan . |
| 464643 | 7/1975 | U.S.S.R. . |

OTHER PUBLICATIONS

Vickers, Metals and their Alloys, Fusible Alloys: Cadmium and Bismuth, pp. 578–588 (1923).

French, The Use of Indium in Fusible Alloys, Metal Industry, pp. 106–107 (Mar. 1937).

Ludwick, Indium, The Indium Corporation of America (1950).

Cerro De Pasco Copper Corporation, History of Cerro Alloys.

The Indium Corporation of America, Indalloy Fusible Alloys (1988).

Stevens & White, Properties and Selection: Indium and Bismuth, Metals Handbook, vol. 2, pp. 750–757 (10th ed. 1990).

The Indium Corporation of America, Indalloy Specialty Solders and Alloys (1988).

*Primary Examiner*—Deborah Yee

[57] ABSTRACT

An alloy composition comprising effective amounts of bismuth, indium, lead, tin, and gallium, which is especially suited for lens blocking.

7 Claims, No Drawings

FUSIBLE ALLOY CONTAINING BISMUTH, INDIUM, LEAD, TIN AND GALLIUM

BACKGROUND OF THE INVENTION

This invention relates to alloys and more particularly to fusible alloys.

Fusible alloys are often used in applications requiring temporary support or anchoring of a component. For example, fusible alloys can be used to support thin walled tubing during bending. After the bending operation, the tube can be heated in an oil or water bath and the melted alloy removed. Similarly, a device or component can be anchored in place by casting melted fusible alloy around it. After the component has been worked on, or when the device needs to be reorientated, the alloy can easily be melted and the anchored item removed. The fusible alloy can be recycled.

One area where fusible alloys have found particular use is in lens blocking. During the production of an optical lens, the glass or plastic lens blank must be locked in position to permit accurate grinding and polishing. This is achieved by attaching the lens blank to a lens block. The lens block, which supports and anchors the lens, can then be clamped into the grinding and polishing machinery.

Before fusible alloys were available, molten pitch was used to fix glass lens blanks to the blocks. However, the pitch was applied at high temperatures, sometimes causing the lens to crack. Further, removal of the pitch required a lengthy cleaning process.

In comparison, fusible alloys can be used at lower temperatures and can be removed easily. The first step in such a lens-blocking process with fusible alloys is to affix the lens blank to the lens block. Next, melted fusible alloy is introduced into the block. The alloy is allowed to solidify as it contacts the block and the lens blank, fixing the lens blank in position. The lens blank is then ground and polished. To remove the lens, the block is struck sharply; the lens pops out cleanly, obviating the need for lengthy cleaning.

Both the lens blocks and the fusible alloy are recycled. The used blocks are heated in a tank of hot water melting the fusible alloy. The blocks can then be removed ready for new lens blanks. The melted fusible alloy collects at the bottom of the hot water tank where it can be drained off for re-use.

To be suitable for lens blocking, a fusible alloy should have a low melting point. The low melting point makes it easier to remove the alloy from used lens blocks; it also means that the melted alloy can be applied to cold lenses without cracking or otherwise damaging them. Alloys with melting points up to about 160° F. can be used for blocking glass lenses. Plastic lenses, however, are much more sensitive and require alloys with melting temperatures below about 130° F.

Two low melting point alloys commonly used in lens blocking are ASTM Alloy 136 and ASTM Alloy 117 (see ASTM Specification B 774 incorporated herein by reference.)

ASTM Alloy 136 is a eutectic with a melting point of 136° F. and comprises 48.5–49.5% by weight bismuth, 17.5–18.5% by weight lead, 11.5–12.5% by weight tin and 20.5–21.5% by weight indium. One such alloy is Indalloy 136, manufactured by the Indium Corporation of America. Indalloy 136 comprises 49.0% by weight bismuth, 18.0% by weight lead, 12.0% by weight tin and 21.0% by weight indium.

ASTM alloy 117 is a eutectic with a melting point of 117° F. and comprises 44.2–45.2% by weight bismuth, 22.1–23.1% by weight lead, 7.8–8.8% by weight tin, 18.6–19.6% by weight indium and 4.8–5.8% by weight cadmium. One such alloy is Indalloy 117 manufactured by the Indium Corporation of America. Indalloy 117 comprises 44.7% by weight bismuth, 22.6% by weight lead, 8.3% by weight tin, 19.1% by weight indium and 5.3% by weight cadmium. ASTM Alloy 117 has a low enough melting temperature to allow it to be used to block plastic lenses.

ASTM Alloy 117, however, suffers from the disadvantage that it contains cadmium. Cadmium is considered toxic by the EPA and other government agencies. The present OSHA standard for cadmium fumes is 0.1 $mg/m^3$. However, the National Institute for Occupational Safety and Health has recommended even more stringent restrictions—namely, a maximum cadmium level of 0.04 $mg/m^3$to protect against the chronic and acute effects of cadmium fumes.

Cadmium can cause problems when used as a lens blocking alloy. If the alloy is overheated, cadmium may fume off from the alloy creating dangerous concentrations of cadmium. Further, if the hot water used to melt the fusible alloy out of the lens blocks is slightly acidic, then cadmium may dissolve in it. The cadmium-containing water is poisonous and great care and expense must be taken in its disposal.

Thus, it would be desirable to provide a low melting point cadmium-free alloy.

It would further be desirable to provide a cadmium-free fusible alloy suitable for lens blocking.

It also would be desirable to provide a cadmium-free fusible alloy with a melting temperature below 130° F. suitable for blocking plastic lenses.

SUMMARY OF THE INVENTION

It is an object of this invention to provide a low melting point cadmium-free alloy. The term "cadmium-free" as used in the specification and claims means that the alloy does not contain cadmium or is essentially free of cadmium.

It is a further object of this invention to provide a cadmium-free fusible alloy suitable for lens blocking.

Another object of this invention is to provide a cadmium-free fusible alloy with a melting temperature below about 130° F. for blocking plastic lenses.

It is a further object of this invention to describe an alloy composition comprising bismuth, indium, lead, tin and gallium.

DETAILED DESCRIPTION OF THE INVENTION

The alloy compositions of the present invention comprise effective amounts of bismuth, indium, lead, tin and gallium. The alloys are suitable for lens blocking. The optimal alloys are those which exhibit a smooth melting curve with a single peak and have a melting temperature below about 130° F., making them suitable for blocking plastic lenses. The melting curve of an alloy can be determined using several milligrams of the alloy in a differential scanning calorimeter (referred to hereafter as "DSC").

In one embodiment, the alloy comprises from about 45% to about 55% by weight bismuth, from about 15% to about 25% by weight indium, from about 12% to about 25% by weight lead, from about 10% to about 15% by weight tin and from more than about 1.0% to less than about 3.4% by weight gallium. A composition comprising about 48.2% by weight bismuth, about 20.6% by weight indium, about 17.7% by weight lead, about 11.8% by weight tin, and about 1.7% by weight gallium is preferred.

The alloy compositions of the present invention can be prepared by techniques well known in the art. For example, measured (by weight) amounts of bismuth, indium, lead, tin and gallium can be placed in a heating vessel. These metals can then be melted together using any conventional melting technique. When the metals have been heated to a temperature at which all the material is liquid, the mixture can be allowed to cool and cast into a suitable mold. After cooling, the alloy can be fabricated into suitable shapes such as rods and the like.

The following examples present illustrative but non-limiting embodiments of the present invention. Unless otherwise indicated in the examples and elsewhere in the specification and claims, all parts and percentages are by weight.

EXAMPLE 1

An alloy was prepared having the following composition:

| | |
|---|---|
| Bismuth | 48.3% |
| Indium | 20.7% |
| Lead | 17.7% |
| Tin | 11.8% |
| Gallium | 1.5% |

Several samples of this composition were tested for liquidus and solidus temperatures. Each DSC melting curve was smooth and had a single peak. The average liquidus temperature was 121.7° F. The average solidus temperature was 119.6° F.

EXAMPLE 2

An alloy was prepared having the following composition:

| | |
|---|---|
| Bismuth | 48.2% |
| Indium | 20.6% |
| Lead | 17.7% |
| Tin | 11.8% |
| Gallium | 1.7% |

Several samples of this composition were tested for liquidus and solidus temperatures. Each DSC melting curve was smooth and had a single peak. The average liquidus temperature was 121.0° F. The average solidus temperature was 118.2° F.

EXAMPLE 3

An alloy was prepared having the following composition:

| | |
|---|---|
| Bismuth | 48.0% |
| Indium | 20.6% |
| Lead | 17.6% |
| Tin | 11.8% |
| Gallium | 2.0% |

Several samples of this composition were tested for liquidus and solidus temperatures. Each DSC melting curve was smooth and had a single peak. The average liquidus temperature was 123.4° F. The average solidus temperature was 120.8° F.

EXAMPLE 4

An alloy was prepared having the following composition:

| | |
|---|---|
| Bismuth | 47.92% |
| Indium | 20.54% |
| Lead | 17.60% |
| Tin | 11.74% |
| Gallium | 2.20% |

Several samples were tested. The average liquidus temperature was 125.2° F. The average solidus temperature was 122.3° F. In each case, the DSC melting curve was smooth and had a single peak.

EXAMPLE 5

An alloy was prepared having the following composition:

| | |
|---|---|
| Bismuth | 47.8% |
| Indium | 20.5% |
| Lead | 17.6% |
| Tin | 11.7% |
| Gallium | 2.4% |

The liquidus temperature was 126.2° F. The solidus temperature was 123.5° F. The DSC melting curve was smooth and had a single peak.

EXAMPLE 6

An alloy was prepared having the following composition:

| | |
|---|---|
| Bismuth | 47.57% |
| Indium | 20.39% |
| Lead | 17.48% |
| Tin | 11.65% |
| Gallium | 2.91% |

The liquidus temperature was 122.9° F. The solidus temperature was 120.5° F. The DSC melting curve was smooth and had a single peak.

When higher percentages of gallium are used, the resulting alloy may exhibit bleeding of liquid metal. For example, bleeding was exhibited in a composition comprising 47.3% bismuth, 17.4% lead, 11.6% tin, 20.3% indium, and 3.4% gallium. The bleeding of liquid metal is undesirable in an alloy because it makes the alloy difficult to store and can lead to changes in the composition and melting characteristics of the remaining alloy.

Although these alloys have been described with regard to their utility for the blocking of plastic lenses, they can be used in many of the applications for which fusible alloys are used. The low melting points of these alloys make them particularly useful where temperature sensitive elements are to be supported or anchored.

While the invention has been explained in relation to its preferred embodiments, it is to be understood that various modifications thereof will become apparent to those skilled in the art. The foregoing disclosure is not intended or to be construed to limit the present invention, or to otherwise exclude any such other embodiments, adaptions, variations and equivalent arrangements, the present invention being limited only by the claims appended hereto and the equivalents thereof.

We claim:

1. A cadmium-free alloy composition comprising effective amounts of bismuth, indium, lead, tin and gallium, to obtain solidus and liquidus temperatures below about 130° F. and above about 110° F.

2. The composition of claim 1 comprising more than about 1% by weight to less than about 3.4% by weight gallium.

3. An alloy composition comprising about 45% to about 55% by weight bismuth, about 15% to about 25% by weight indium, about 12% to about 25% by weight lead, about 10% to about 15% by weight tin, and more than about 1.0% to less than about 3.4% by weight gallium.

4. The composition of claim 3, further having a solidus and liquidus temperature below about 130° F.

5. The composition of claim 3 comprising about 48.2% by weight bismuth, about 20.6% by weight indium, about 17.7% by weight lead, about 11.8% by weight tin, and about 1.7% by weight gallium.

6. The alloy of claim 1 comprising at least about 45% bismuth by weight and less than about 55% by weight of indium, lead, tin and gallium.

7. The alloy of claim 6 comprising less than about 3.4% by weight gallium.

* * * * *